United States Patent [19]

Perraud

[11] 4,215,953

[45] Aug. 5, 1980

[54] DEVICE FOR INJECTING CARTRIDGES OF RESIN FOR BOLTING APPARATUS

[75] Inventor: Raymond J. Perraud, Villeurbanne, France

[73] Assignee: Envirotech Corporation, Menlo Park, Calif.

[21] Appl. No.: 938,139

[22] Filed: Aug. 30, 1978

[51] Int. Cl.[2] ..... E21C 11/00

[52] U.S. Cl. ..... 405/303; 405/259

[58] Field of Search ..... 405/232, 259, 260, 261, 405/303; 227/112; 243/25; 302/2 R; 173/43, 45, 147, 150; 81/54, 55

[56] References Cited

U.S. PATENT DOCUMENTS

| | | | |
|---|---|---|---|
| 2,887,685 | 5/1959 | Cast | 227/112 X |
| 3,807,655 | 4/1974 | Bull | 243/25 |

FOREIGN PATENT DOCUMENTS

| | | | |
|---|---|---|---|
| 1217318 | 5/1966 | Fed. Rep. of Germany | 405/259 |
| 2222646 | 11/1972 | Fed. Rep. of Germany . | |

*Primary Examiner*—David H. Corbin

*Attorney, Agent, or Firm*—Hal J. Bohner; Robert E. Krebs

[57] ABSTRACT

A resin cartridge injection device for use in roof bolting apparatus in the mining industry includes a turret carrying both the hole drilling carriage and the bolt inserting carriage as well as a feed line for introducing the resin cartridge or cartridges into the drilled hole, before bolt insertion, by way of a flexible hose from a remote control station. The cartridges are conveyed from the control station into the hole pneumatically. Indexing of the turret will select either the drilling carriage, the cartridge inserter or the bolt insertion carriage into an operating position, as desired.

8 Claims, 4 Drawing Figures

DEVICE FOR INJECTING CARTRIDGES OF RESIN FOR BOLTING APPARATUS

The present invention relates to a device for injecting cartridges of resin for bolting apparatus and more particularly, although not exclusively, for drilling and bolting apparatus to be used for roof bolting a mine gallery, comprising a pivotal turret which carries a drilling carriage and a bolting carriage.

The conventional roof propping technique consists in drilling holes in the roof of the gallery, and then engaging in each of these a bolt carrying at its end a nozzle which, by an expansion effect, comes to anchor itself in the end of the hole so that the gripping of this bolt provokes compression of the ground in the form of a column coaxial with said bolt. For drilling the hole, the insertion of the bolt and the gripping of the bolt, it is known to use an apparatus which, as indicated above, comprises a pivoting turrent carrying a drilling carriage and a bolting carriage. The drilling carriage constitutes a drill for initially drilling the hole; thereafter the turret rotates about its axis of pivoting, provided by a pin with its tip anchored in the roof of the gallery so that the second carriage can be brought up to the axis of the previously drilled hole for introduction of the bolt and its actuation for gripping the hole wall. Such an apparatus is in particular described in French Pat. No. 1,359,297.

The recent development of the technique of propping has envisaged the replacement of the expansion bolts by bolts sealed in resin. The resin used is in the form of elongate cartridges which may be introduced manually in the previously drilled hole before insertion of the bolt. However, the manual introduction of the cartridges requires time and manual labour; furthermore, it is difficult to carry out if the "roof" of the gallery is at a considerable height.

For reducing the human participation in this operation, it has already been envisaged that the bolting turret described above may be coupled with a device for injecting cartridges of resin. After the hole has been drilled, the turret is indexed pivotally into an intermediate position, where the device for injecting cartridges is brought onto the axis of the bolt. One or several cartridges may thus be introduced in the hole by mechanical or pneumatic means. Finally a second indexing rotation of the turret brings the bolting carriage onto the axis of the hole in which the cartridge or cartridges of resin already is or are.

A turret "three position" of this type, in which the cartridges are introduced in the hole propelled by compressed air, has been researched and built by the Company S.E.C.M., and tried out in mines. The study, the construction, and the tests of this turret have been written up in "Bulletin Techniques des Mines de Fer", and more precisely in issue No. 83 at page 118, in issue No. 86 at page 26, in issue No. 90 at page 30 and in issue No. 96 at page 197 of this publication. Furthermore, a similar construction is described in German Patent Application No. 2,222,646.

This latter document describes, inter alia, one embodiment in which the resin cartridges are introduced by means of compressed air. The cartridges are placed in a tube which is carried by the turret and is disposed parallel to the axis of pivoting of the turret, and a sealed closure shutter is provided at the lower end of the tube to permit insertion of cartridges. A conduit ending at the lower part of this tube is connected to a source of compressed air for propulsion of the cartridge into the hole.

The main disadvantage of this pneumatic resin cartridge injection device resides in the fact that the operator has to stand beside the turret for effecting the loading of cartridges in the tube. This loading operation is dangerous in that the operator must place himself under a part of the "roof" of the gallery which has not yet been stabilised by the installation of the bolts.

The aim of the present invention is to overcome this disadvantage, by providing an improved device for injecting cartridges of resin, which not only permits mechanisation of this resin introduction and bolt insertion operation but also, and importantly, enables it to be carried out under the best conditions of security for the operator.

Accordingly, the present invention provides a cartridge injecting device for roof bolting apparatus for propping the "roof" of a mine gallery, comprising: (a) a pivoting turret which carries a drilling carriage, a bolting carriage, and a cartridge injection line such injection line comprising a rigid conduit having one end capable of being applied against the mouth of a previously drilled hole, the rigid conduit being extended at its other end by a flexible hose ending remote from the turret at a tube in which the cartridges may be initially introduced; and (b) a source of compressed air connected to said tube for initial introduction of the cartridges.

With such a device, the cartridges may be introduced into the holes without the operator needing to come under the bolting turret; the operator may instead control the entire operation while working at a control station for the apparatus, and thus standing under a part of the "roof" of the gallery already stabilised by the installation of the preceeding bolts. It should be noted that the operator may, thanks to the present invention, come no closer than 6 meters from the turret, and that the usual consistency of the resin cartridges ensures that they may, without difficulty, follow curves in such a flexible conduit made necessary by the movements of the turret relative to the control station.

In one embodiment, the injection line comprises a slide which has a lateral opening and is fixed to the turret parallel to the axis of pivoting of the turret, said rigid conduit being mounted slidably within the said slide, this rigid conduit including in its upper part a nozzle capable of being applied against the mouth of the previously drilled hole and, at its lower part, extended by a bent tube which leaves the slide by the lateral opening of the slide and is connected to one end of the flexible hose, means being provided for controlling the displacement of the said tube with respect to the slide.

The sliding mounting of the rigid conduit housed within the slide, and of the nozzle thereof, permits actual application of this nozzle against the mouth of the hole in order to ensure continuity between the injection line and the hole. The translatory movement of the assembly makes it necessary to open the slide and is permitted by the use of the flexible hose. This movement is for example controlled by a double-acting jack, housed in the lower part of the said slide and having its piston rod connected to the assembly formed by the sliding rigid conduit and the bent tube.

In an alternative embodiment, the movement may also be controlled by a motor, for example an hydraulic motor, disposed in the lower region of the said slide and driving, by means of a chain, a carriage which is mounted slidably in the said slide and on which the bent tube is fixed.

The tube, remote from the turret, into which the cartridges are initially introduced may be fed by compressed air from a pneumatic device comprising: a compressor, a buffer reservoir connected to the compressor by a conduit in which is interposed a pressure control member, and another conduit connecting the buffer reservoir to a valve permitting the admission of compressed air to the interior of the said cartridge introduction tube. This device, with its pressure control device and its buffer reservoir, serves for propelling the cartridges into the interior of the hole in a certain manner and without damaging them.

The tube in which the cartridges are initially introduced preferably comprises a cylindrical cavity connected to the source of compressed air and extended, in the forward direction, by an opening having a frusto-conical wall onto which wall is applied initially a flange of the cartridge to be injected, the rear end of the tube carrying a valve which permits closing of the said end or gaining access to the interior of the tube. Thanks to the frusto-conical part, this embodiment permits the insertion of several cartridges with a high initial speed making them travel reliably through the flexible hose leading firstly to the turret then to the rigid conduit of the injection line. The valve provided at the rear of the tube allows introduction of the cartridges manually, and when closed the valve must quite clearly be perfectly air-tight.

In order that the present invention may better be understood, the following description is given with reference to the accompanying drawings representing, by way of non-limiting examples, two embodiments of the device for injecting cartridges of resin in accordance with the invention. In the drawings.

Figure 1:
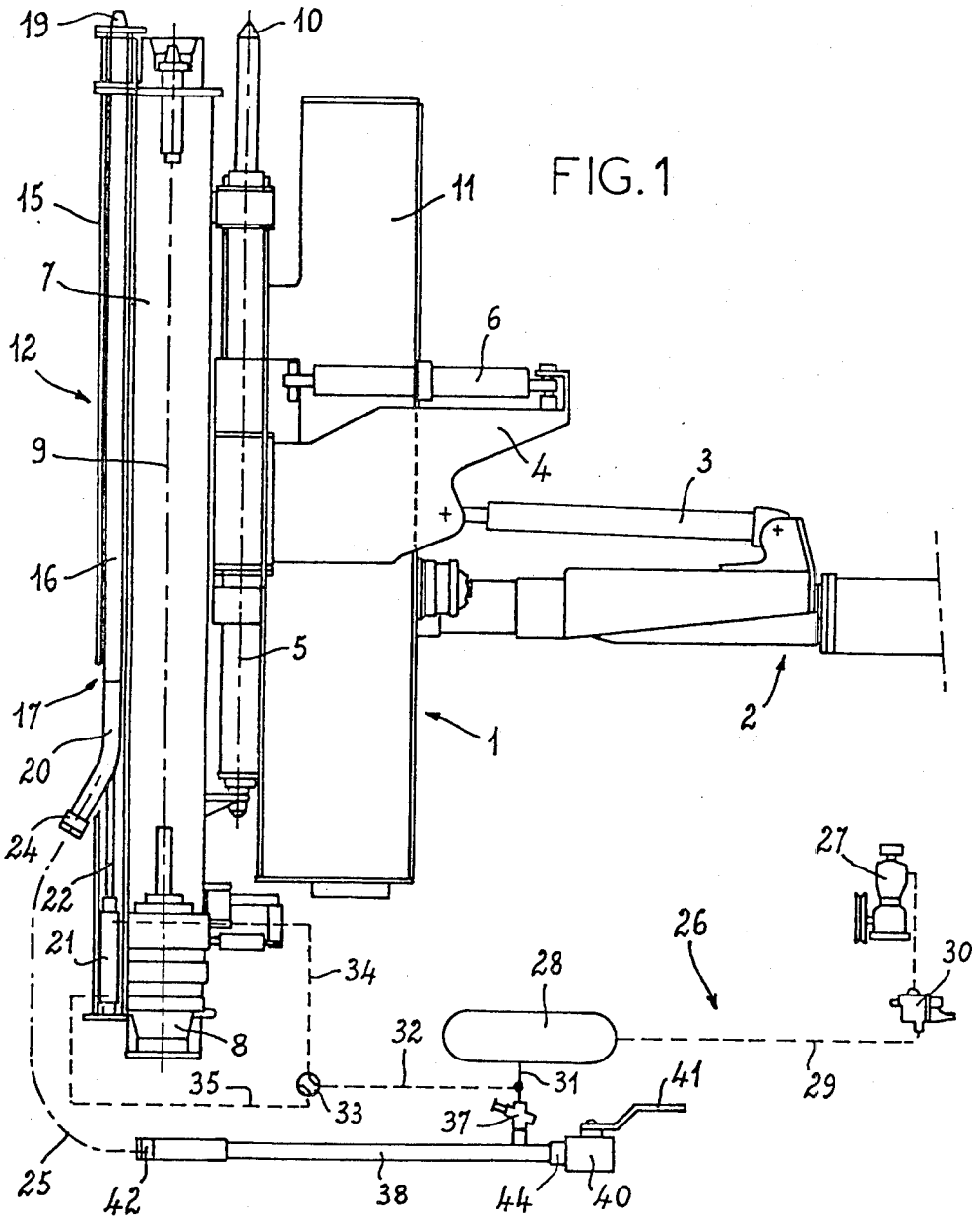
FIG. 1 is a general view, from the side, of a bolting turret provided with the cartridge injecting device according to the invention.

The invention is applied to a bolting turret 1 mounted at the end of a support arm 2 and has its inclination relative to the arm 2 controlled by means of a jack 3 as shown in FIG. 1. The turret 1 is rotatably mounted on a support 4 for rotation about a shaft 5 which is shown vertical on the drawing but may take any desired inclination according to the position of the jack 3. Another jack 6, articulated on the one hand to the support 4 and on the other hand to a point of the turret 1 enables the turret to be driven in a controlled manner for pivoting about the shaft 5.

The turret 1 essentially comprises (a) a beam 7 which extends parallel to the shaft 5 and serves as slide for a drilling carriage 8 situated in front of the beam and therefore visible in FIG. 1, and also (b) a bolting carriage which is situated behind the beam 7 and consequently concealed from view in this drawing. The axis 9 of the drill of the drilling carriage 8 and the axis of the bolting device of the bolting carriage are equidistantly situated in front of and behind the pivot shaft 5 of the turret 1. This permits first drilling of a hole and then guiding a bolt exactly along the axis of this pre-drilled hole, by pivoting the turret around the shaft 5 while the shaft 5 is maintained fixed by virtue of an anchorage spike 10 provided at the top of the turret.

The turret shown here by way of example is equipped with a bolt magazine 11 fixed to the support 4. This magazine may contain a number of bolts constituting a reserve for several successive bolt insertion operations, may comprise an advancing mechanism for guiding bolts successively onto the axis of the bolt inserting mechanism of the second carriage carried by the turret 1.

Figure 2:
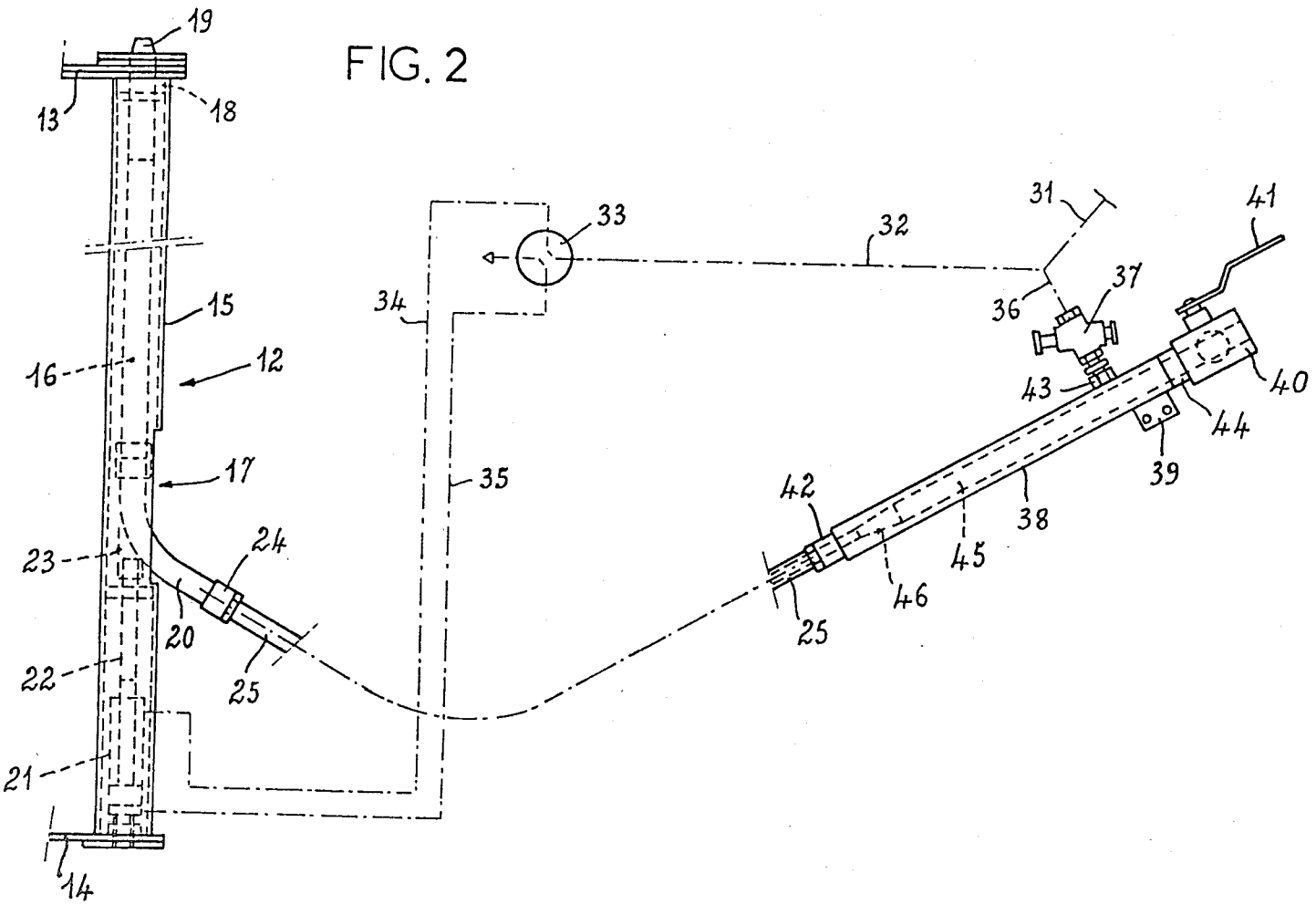
FIG. 2 shows in greater detail the device for injecting cartridges of resin.

This turret 1 furthermore carries an injection line for resin cartridges, indicated generally at 12. This cartridge insertion line 12 is fixed to the top and the bottom of the beam 7 by means of supports 13 and 14 visible in FIG. 2. The injection line 12 is thus fixed between the drilling carriage 8 and the bolting carriage with its axis situated at the same distance from the axis of pivot shaft 5 of the turret as are the axes of the drill and of the bolting device. In FIGS. 1 and 2, the injection line 12 comprises an external casing 15 and a coaxial internal tube 16. The casing 15 extends over the entire height of the turret 1 and has a lateral elongated opening 17. The internal tube 16 is mounted axially slidably in the casing 15. The upper part is guided in a sleeve 18 (FIG. 2) and extended by a conical nozzle 19. The lower end of the tube 16 is connected to another shorter tube 20, of bent form which leaves the casing 15 by a lateral opening 17.

The lower part of the casing 15 houses a double-acting pneumatic jack 21 whose piston rod 22 is directed upwardly and is fixed to the bent tube 20 in the region of its elbow by means of a component 23 (FIG. 2). This jack 21 permits upward and downward displacement of the assembly of the two tubes 16 and 20.

The outer end of the bent tube 20 carries a coupling 24 to which is fixed one end of a flexible hose 25 connected at the other end to the pneumatic device 26 shown here adjacent the turret 1 but, in reality, situated at the control station for the apparatus, remote from the turret.

The pneumatic device 26 comprises a compressor 27, driven for example by an electric motor (not shown), and generating compressed air which is then fed to a buffer reservoir 28 along a conduit 29 which includes a pressure control device 30.

From the buffer reservoir 28, another conduit 21 divides into two branches.

One of these branches is constituted by a tube 32 terminating at a rotary valve 33 which has a closed position and two open positions diverting the air flow into two flexible channels 34 and 35 which feed the double-acting jack 21. According to its selected configuration the valve 33 controls the raising, the descent, or even immobilisation, of the piston rod 22 of this jack 21.

The other branch 36 from the conduit 32 ends at a valve 37 whose body is connected to a tube 38 fixed by a bracket 39 to the control station frame of the apparatus. The rear end of this tube 38 carries the body of another valve 40 controlled by a lever 41, which enables the said end to be closed or, on the contrary, to enable access to be gained to the interior of this tube 38 from the rear. The forward end of this same tube 38 forms a coupling 42 to which is fixed that end of the flexible hose 25 which is remote from the turret 1.

Figure 3:
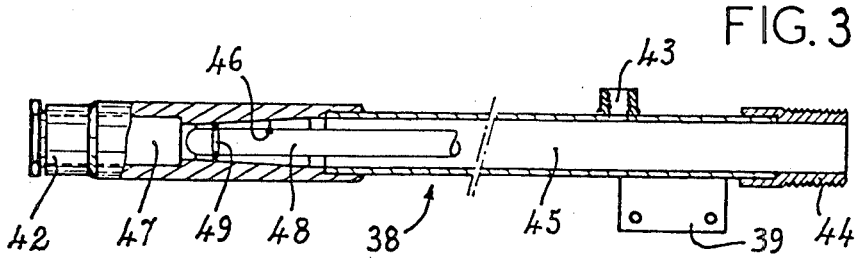
FIG. 3 is a cross-sectional view, on an increased scale, of the tube into which the cartridges are initially introduced.

FIG. 3 shows, in more detail, the couplings 43 and 44 to the tube 38 for fixing the valves 37 and 40 to the tube, and also the internal structure of this tube. Its rear part, where the couplings 43 and 44 occur, and also the central part, form a cylindrical cavity 45 of constant diameter. Ahead of this cavity 45 is provided an opening 46 of frusto-conical form convergent in the forward direction. Furthermore the frusto-conical opening 46 communicates with a cylindrical chamber 47 situated in the forward part of the tube 38, the diameter of this chamber corresponding to the internal diameter of the flexible hose 25 to be connected thereto.

After having drilled a hole with the aid of the drilling carriage 8, the jack 6 is operated to pivot the turret 1 through a given angle which brings the cartridge injection line 12 exactly onto the axis of the hole, and the device for injecting cartridges of resin is then operated in the following manner:

On the one hand, the valve 33 is actuated so that the jack 21 is supplied with air in the direction of raising the piston rod 22. The tubes 16 and 20 are thus displaced upwardly, the elongate opening 17 of the casing 15 allowing displacement of the tube 20, and the nozzle 19 is thus applied against the mouth of the previously drilled hole.

On the other hand, the valve 40 is opened by means of the lever 41 and a cartridge 48 of resin, carrying in its forward part a flange 49 of plastics material, is introduced from behind into the tube 38 and is pushed into the latter just up to the point when the flange 49 comes into contact with the tapering wall of the frusto-conical opening 46, as shown in FIG. 3. The valve 40 is then reclosed, and the valve 38 then opened to admit compressed air to the interior of the tube 38.

Initially, the flange 49 serves as a sealing gasket and holds the cartridge 48 in the interior of the tube 38. Once the pressure in the tube becomes sufficiently high the cartridge 48 is projected forwardly at an initial speed sufficiently high for it to be able to travel along the flexible hose 25 and then the tubes 20 and 16, and finally to enter into the drilled hole guided by the nozzle 19. This release of the cartridge is made possible by deformation of the plastic flange 49 on the cartridge.

After introduction of one or several resin cartridges into the hole following this process, the double-acting jack 21 is again operated to lower the tubes 16 and 20, then the jack 6 is operated to pivot the turret 1 through a given angle to bring the bolting carriage into line with the axis of the hole. A bolt is then introduced and sealed and finally the turret 1 may be removed and led to another point where the same cycle is repeated.

Figure 4:
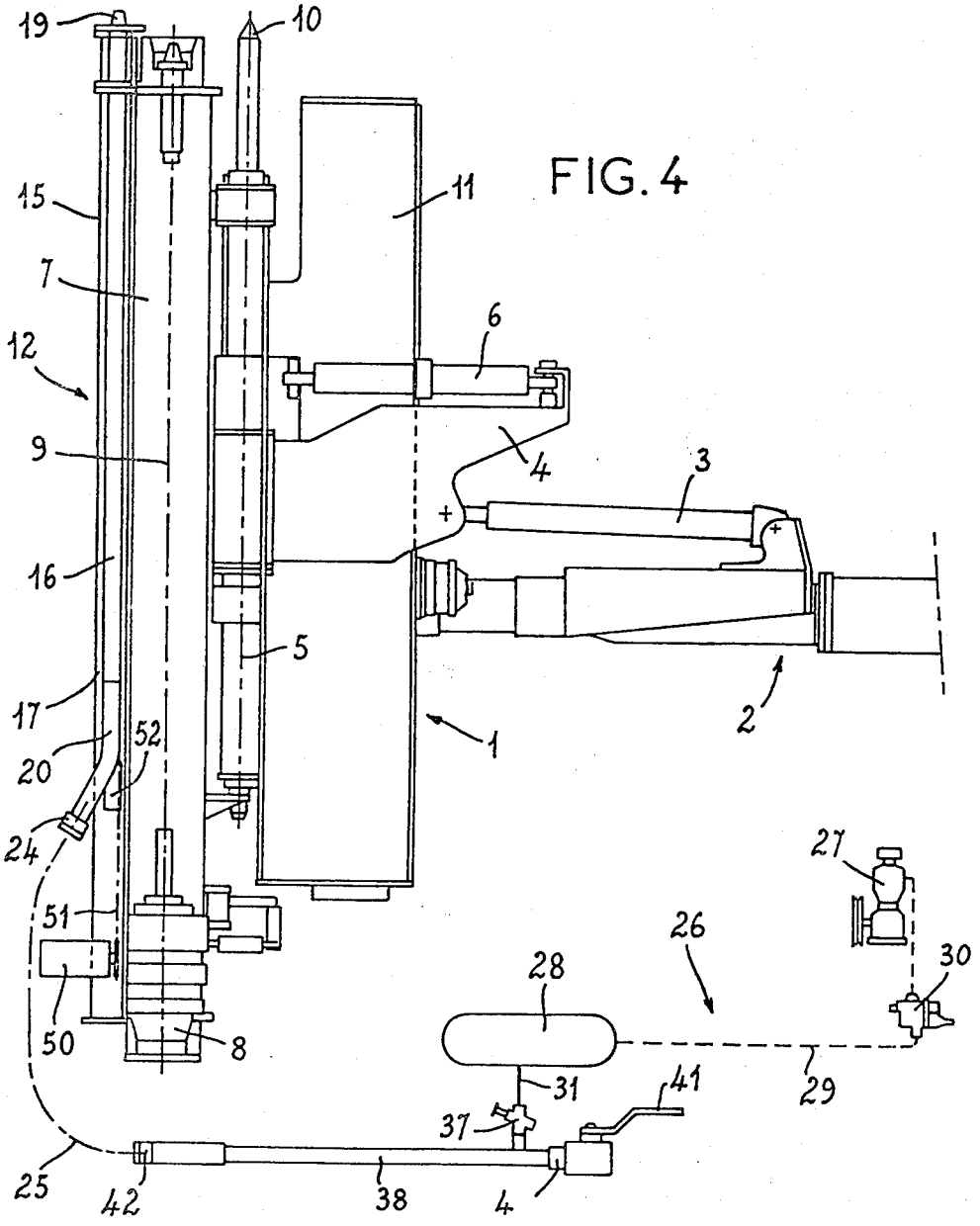
FIG. 4 is a side view similar to FIG. 1, illustrating another embodiment of the device according to the invention.

FIG. 4 shows a different embodiment of the device according to the invention. In this case the double-acting pneumatic jack 21 is omitted and replaced by a different drive mechanism. The injection line 12 again comprises a slide tube 16 connected to a bent tube 20 itself extended by the flexible hose 25. The assembly formed by the two tubes 16 and 20 is mounted slidably in a slide 15 which presents a lateral opening 17 extending along the whole of its height to allow the bent tube 20 to pass through the side of the casing and to move therealong.

The drive mechanism comprises a rotary hydraulic motor 50 fixed in the lower part of the slide 15. The motor 50 drives an endless chain 51 having a carriage 52 attached to one part thereof, the carriage 52 being mounted slidably in the slide 15. The bent tube 20 is fixed to the carriage 52. The functioning of the apparatus is not different from that described above, apart from the fact that the rotary motor 50 is operated in place of the jack 21 in order to bring the nozzle 19 adjacent the mouth of the hole or to remove it therefrom.

I claim:

1. A cartridge injecting device for roof bolting apparatus for propping the roof of a working such as a mine gallery, comprising:

(a) pivoting turret means having a pivot shaft;

(b) drilling carriage means carried by said turret means;

(c) cartridge injection conduit means carried by said turret means and comprising a rigid conduit having a first end capable of being applied against the mouth of a previously drilled hole in the roof of the working, and a second end;

(d) a flexible hose having one end coupled to the second end of said injection conduit means and coaxial therewith so that a cartridge can pass from said flexible hose into said injection conduit;

(e) cartridge receiving tube means remote from the turret means and into which cartridges may be initially introduced, said flexible hose having its other end connected to said cartridge receiving tube means so as to be coaxial therewith; and (f) a source of compressed air connected to said cartridge receiving tube means.

2. A cartridge injection device according to claim 1, wherein said cartridge injection conduit means comprises: slide support means slidably supporting said rigid conduit for movement therealong, means defining lateral opening in said slide support means, means mounting said slide support means on the turret means parallel to the pivot shaft whereby said rigid conduit has an upper part and a lower part; wherein said rigid conduit includes at its upper part a nozzle capable of being applied against the mouth of the previously drilled roof hole, elbow tube means joined to the lower part of said rigid conduit and extending through said lateral opening of the slide support means, means being provided to connect said elbow tube means to said one end of the flexible hose; and wherein means are provided for controlling the displacement of said rigid conduit and elbow tube along said slide.

3. A cartridge injection device according to claim 2, and including a double-acting jack received in said slide, said jack having a piston rod which is connected to said rigid conduit and said elbow tube for displacing the assembly of said conduit and elbow tube upwardly and downwardly.

4. A cartridge injection device according to claim 2, including a rotary motor disposed in said slide, a carriage slidably mounted in said slide and carrying said elbow tube, and a chain connected to said carriage and motor.

5. A cartridge injection device according to claim 4, wherein said motor is an hydraulic motor.

6. A cartridge injection device according to any one of claims 1 to 5, and including a pneumatic device for supplying compressed air to said cartridge receiving tube means, and comprising: a compressor, a buffer reservoir, a pressure control device, an inlet valve for admitting compressed air to the interior of said cartridge receiving tube means, a first conduit including said pressure control device and connecting said buffer reservoir and said compressor, and a second conduit connecting the buffer reservoir to said inlet valve.

7. A cartridge injection device according to claim 6, and including: a double-acting pneumatic jack received in said slide support means, said jack having a piston rod which is connected to said rigid conduit for displacing the assembly of said conduit upwardly and downwardly; and flexible pipes connecting said buffer reservoir to said pneumatic jack for supplying compressed air to said jack.

8. A cartridge injection device according to any one of claims 1 to 5, wherein said cartridge receiving tube means comprises a cylindrical cavity, means connecting said cylindrical cavity to said source of compressed air, means extending said cylindrical cavity to define a frusto-conical opening at a first end thereof, and a valve at the second end of said cylindrical cavity for closing off said second end or allowing access to the interior of the cylindrical cavity by way of said valve for insertion of a cartridge.

* * * * *